United States Patent [19]

Pelton

[11] 4,203,581

[45] May 20, 1980

[54] APPARATUS FOR REFINING MOLTEN ALUMINUM

[75] Inventor: John F. Pelton, Yorktown Heights, N.Y.

[73] Assignee: Union Carbide Corp., New York, N.Y.

[21] Appl. No.: 25,662

[22] Filed: Mar. 30, 1979

[51] Int. Cl.[2] ..... C22B 9/00

[52] U.S. Cl. ..... 266/217; 266/235

[58] Field of Search ..... 266/225, 235, 275, 217

[56] References Cited

U.S. PATENT DOCUMENTS

| | | | |
|---|---|---|---|
| 3,743,263 | 7/1973 | Szekely | 266/225 |
| 4,021,026 | 5/1977 | Szekely | 266/275 |
| 4,040,610 | 8/1977 | Szekely | 266/235 |

*Primary Examiner*—M. J. Andrews

*Attorney, Agent, or Firm*—Saul R. Bresch

[57] ABSTRACT

In an apparatus for refining molten metal comprising, in combination:

(a) a vessel;

(b) inlet and outlet means for molten metal and gases; and (c) at least one rotating gas distributing means disposed in said vessel, said gas distributing means comprising (i) a rotatable shaft coupled to drive means at its upper end and fixedly attached to a vaned circular rotor at its lower end; (ii) a hollow stationary sleeve surrounding said shaft and fixedly attached at its lower end to a hollow circular stator; (iii) an axially extending passageway for conveying and discharging gas into the clearance between the rotor and stator, said passageway being defined by the inner surface of the sleeve and stator and the outer surface of the shaft; and (iv) means for providing gas to the upper end of the passageway under sufficient pressure to be injected into the vessel, the improvement comprising utilizing, in the combination, a smooth outer surface construction for the stator and a ratio of the diameter of the stator to the root diameter of the rotor in the range of 1:1 to about 0.8:1.

4 Claims, 2 Drawing Figures

APPARATUS FOR REFINING MOLTEN ALUMINUM

FIELD OF THE INVENTION

This invention relates to apparatus for refining molten metal.

DESCRIPTION OF THE PRIOR ART

Although the invention described herein has general application in refining molten metals, it is particularly relevant in refining aluminum, magnesium, copper, zinc, tin, lead, and their alloys and is considered to be an improvement over the apparatus described in U.S. Pat. No. 3,743,263 issued July 3, 1973, which is incorporated by reference herein.

Basically, the process carried out in the reference apparatus involves the dispersion of a sparging gas in the form of extremely small gas bubbles throughout a melt. Hydrogen is removed from the melt by desorption into the gas bubbles, while other non-metallic impurities are lifted into a dross layer by flotation. The dispersion of the sparging gas is accomplished by the use of rotating gas distributors, which produce a high amount of turbulence within the melt. The turbulence causes the small non-metallic particles to agglomerate into large particle aggregates which are floated to the melt surface by the gas bubbles. This turbulence in the metal also assures thorough mixing of the sparging gas with the melt and keeps the interior of the vessel free from deposits and oxide buildups. Non-metallic impurities floated out of the metal are withdrawn from the system with the dross while the hydrogen desorbed from the metal leaves the system with the spent sparging gas.

The rotating gas distributor described in the aforementioned patent has, among its other features of construction, a shaft and a vaned rotor (coupled to the shaft) and a vaned stator which interact to provide a desirable bubble pattern in the melt. The device, when in operation, induces flow patterns in the metal in the vicinity of the device such that the gas bubbles which are formed, are transported along a resultant flow vector which is radially outward with a downward component relative to the vertical axis of the injection device. These flow patterns have several advantageous effects. First, essentially vertical stirring is provided in the body of the melt, whereby a downwardly directed flow along the device, in combination with the rotating vanes, causes subdivision of the gas into small discrete gas bubbles. Second, the rapid conveyance of the gas bubbles away from the point of introduction into the melt prevents bubble coalescence in the zone where the gas bubble concentration is the highest. Third, the gas residence time of the well dispersed gas bubbles in the melt is prolonged, because the gas bubbles do not immediately upon formation, rise to the surface under the influence of gravity.

In the first embodiment of the rotating gas distributing device, the shaft to which the vaned rotor was attached was made of a heat resistant metal; however, when it was necessary to use a process gas containing a small amount of halogen, the metal shaft was badly eroded. The most practical shaft, therefore, was found to be graphite, which is not susceptible to halogen attack. During operation, however, the more fragile graphite shaft occasionally breaks resulting in a costly failure in terms of replacement parts, down-time, and manpower.

The cause of this failure appears to arise from the fact that solid particles of various shapes with dimensions from a fraction of an inch up to several inches are sometimes found in the melt. It is believed that these particles temporarily lodge at points where the vanes or the channels between the vanes of the stator and the rotor coincide during operation and jam the device, sufficient force being generated to break the shaft.

SUMMARY OF THE INVENTION

An object of this invention, therefore, is to provide an improvement in metal refining apparatus which avoids such shaft failures and yet provides a desirable bubble pattern with the proper flow vector.

Other objects and advantages will become apparent hereinafter.

According to the present invention, such an improvement has been discovered in known apparatus for refining molten metal comprising, in combination:

(a) a vessel;

(b) inlet and outlet means for molten metal and gases; and (c) at least one rotating gas distributing means disposed in said vessel, said gas distributing means comprising (i) a rotatable shaft coupled to drive means at its upper end and fixedly attached to a vaned circular rotor at its lower end; (ii) a hollow stationary sleeve surrounding said shaft and fixedly attached at its lower end to a hollow circular stator; (iii) an axially extending passageway for conveying and discharging gas into the clearance between the rotor and stator, said passageway being defined by the inner surface of the sleeve and stator and the outer surface of the shaft; and (iv) means for providing gas to the upper end of the passageway under sufficient pressure to be injected into the vessel.

The improvement comprises utilizing, in the defined combination, a smooth outer surface construction for the stator and a ratio of the diameter of the stator to the root diameter of the rotor in the range of 1:1 to about 0.8:1.

DESCRIPTION OF THE PREFERRED EMBODIMENT

Figure 1:
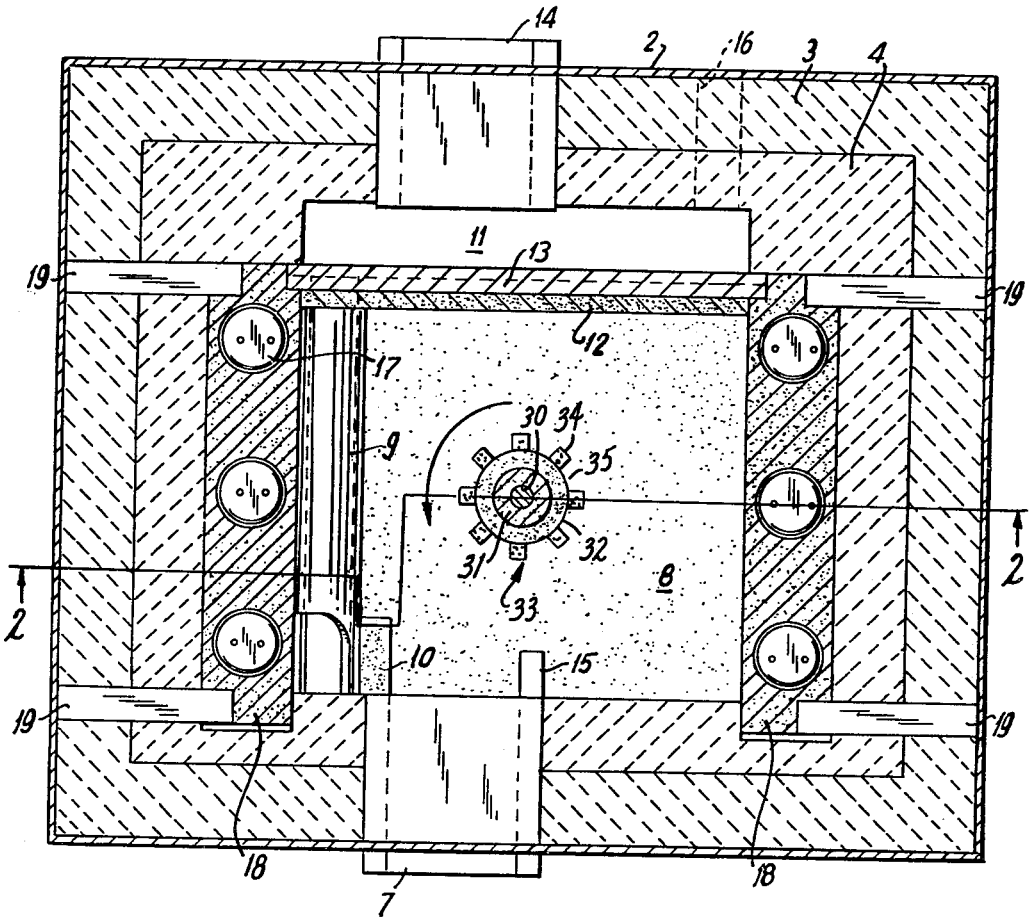
FIG. 1 is a schematic diagram of a plan view in section of an embodiment of subject apparatus.

Apparatus to which the improvement is preferably applied are shown in United States patents Nos. 4,040,610 and 4.021,026, which are incorporated by reference herein. For the sake of illustration, the apparatus described in the drawing is, except for the improvement, that in United States Pat. No. 4,040,610. Referring to the drawing:

The apparatus shown in FIGS. 1 and 2 has a single rotating gas distributing means which will be described below.

Outer wall 2 of the furnace is typically made of steel. Inside of wall 2 is refractory 3 of low thermal conductivity cemented brick as a first insulator and inside refractory 3 is refractory 4, a castable alumina impervious to the melt. A typical castable alumina is 96% $Al_2O_3$, 0.2% $Fe_2O_3$, and balance other materials. Refractory 4 is also of low thermal conductivity and, of course, provides further insulation. The outer structure is completed with furnace cover or roof 5 and a superstructure (not shown), which supports the gas distributor and an electric motor (not shown).

The refining operation begins with the opening of sliding doors (not shown) at the entrance of inlet port 7. The molten metal enters working compartment 8 (shown with melt) through inlet port 7 which may be lined with silicon carbide blocks. The melt is vigorously stirred and sparged with refining gas through the rotating gas distributor. The rotation of the rotor of the distributor is counterclockwise; however, the circulation pattern induced in the melt by the distributor has a vertical component. Vortex formation is reduced by offsetting the symmetry of working compartment 8 with exit pipe 9 and baffles 10 and 15.

The refined metal enters exit pipe 9 located behind baffle 10 and is conducted into exit compartment 11. Compartment 11 is separated from working compartment 8 by graphite block 12 and silicon carbide block 13. The refined metal leaves the furnace through exit port 14 and is conducted, for example, to a casting machine under a level flow. The bottom of the furnace is lined with graphite plate 6.

The dross floating on the metal is caught by block 15 acting as both a baffle and a skimmer and collects on the surface of the melt close to inlet port 7 from where it can easily be removed. The spent sparging gas leaves the system beneath the sliding doors (not shown) at the entrance. Head space protection over the melt is provided by introducing an inert gas such as argon into the furnace through an inlet pipe (not shown). The atmosphere in exit compartment 11, however, is not controlled and, therefore, graphite block 12 is used there only below the surface of the melt.

Tap or drain hole 16 is provided for draining the furnace when alloy changes are made. It can be located on the inlet or outlet side of the furnace.

Heat is supplied to the furnace, in this embodiment, by six nickel-chromium electric resistance heating elements 17 which are inserted into dual function (lining+heating) graphite blocks 18, three in each block. Blocks 18 are kept in place by steel clips 19 and by blocks 12 and 13, which, in turn, are retained by the use of slots and recesses (not shown). Blocks 18 are free to expand toward the inlet side of the furnace and upward.

Roof 5 is in a sealed relationship with the rest of the furnace through the use of flange gasket 20 and is protected from the heat by several layers of insulation 21. An example of the kind of insulation used is aluminum foil backed fibrous aluminum silicate. A bath thermocouple is provided with a protection tube (not shown).

Each heating element 17 is slidably attached to roof 5 so that it can move as dual function block 18 expands. Element 17 is inserted in a hole drilled in block 18. Contact between element 17 and block 18 is prevented by spacer 24 and heat baffle 25. Provision for slidable attachment is made to accommodate the thermal expansion of dual function block 18. Wwhen the furnace is brought up to operating temperature and block 18 has expanded element 17 is then fixed in position. When the furnace is cooled down for any reason, element 17 attachment (not shown) to roof 5 is loosened so that it can move freely with the contraction of block 18. Elements 17 are usually perpendicular to the roof and bottom of the furnace and parallel to each other.

It is preferred that the material used for the various blocks and other pieces is graphite. Where any graphite is above the level of the melt, however, it is suggested that the graphite be coated with, e.g., a ceramic paint, or that other protection is provided against oxidation even though seals and a protective atmosphere are utilized or silicon carbide can be substituted for the graphite.

A motor, temperature control, transformer, and other conventional equipment (all not shown) are provided to drive the distributor and operate heating elements 17. Sealing of inlet and outlet ports, piping, and other equipment to protect the integrity of a closed system is also conventional and not shown.

Although there is one rotating gas distributing means (gas distributor) shown in the described apparatus, two or more can be used provided the size of the apparatus is increased proportionately. The gas distributor or gas injection device shown is comprised of a rotor 33 having vanes 34 and channels 35 between the vanes. Rotor 33 is rotated by means of a motor (not shown) through shaft 30 to which it is attached. Shaft 30 is shielded from the melt by hollow sleeve 31 and hollow stator 32 to which the sleeve is secured. The outer surface of the stator is smooth. There is sufficient clearance between rotor 33 and stator 32 to permit free rotation of rotor 33 and to permit outward free flow of the process gas. The internal design of the device is such that there is a passageway (not shown) defined by shaft 30 and the inner surfaces of sleeve 31 and stator 32 through which gas can be introduced and forced out into the clearance between rotor 33 and stator 32. Shaft 30 and sleeve 31 and stator 32 have the same axis and thus the passageway is parallel to and surrounds this axis. Means for supplying gas to the upper end of the passageway under sufficient pressure to be injected into the vessel and melt are provided but are not shown.

Figure 2:
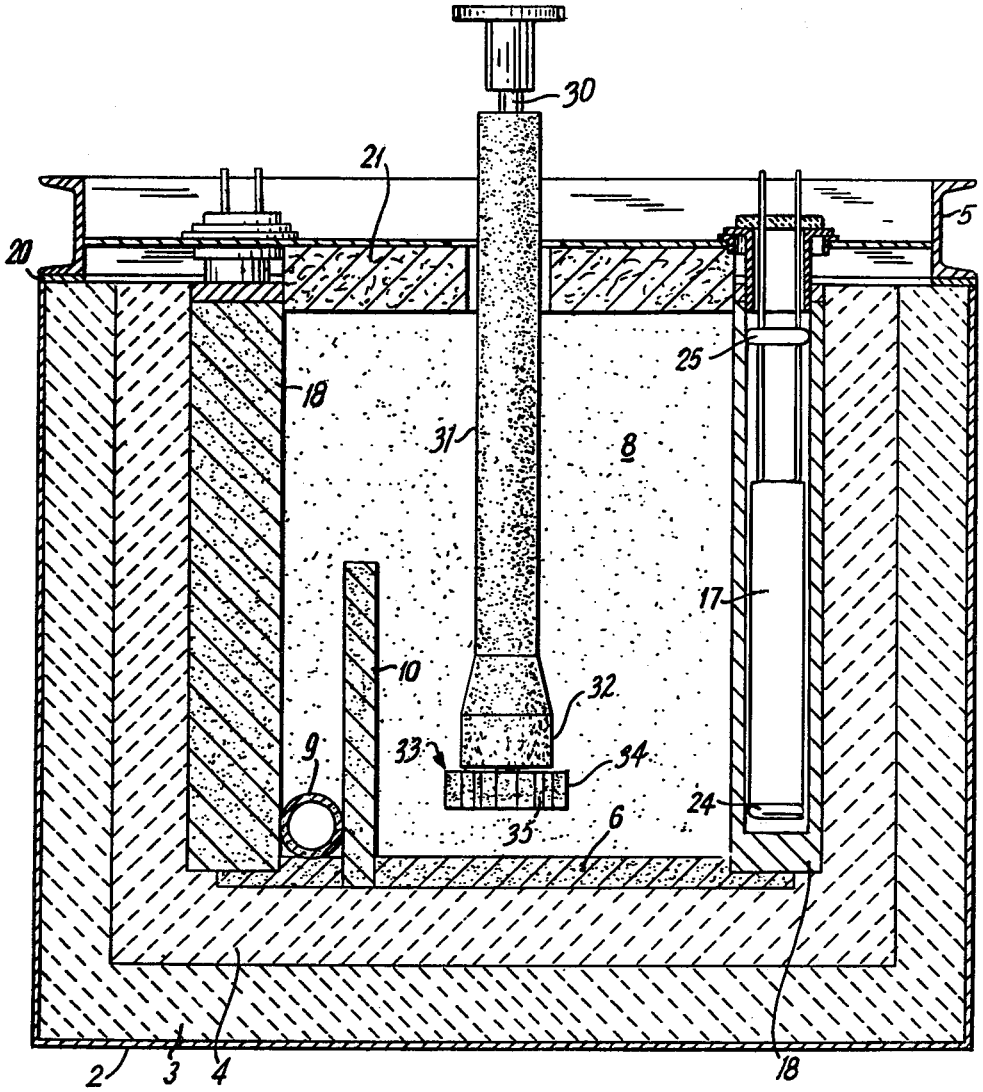
FIG. 2 is a schematic diagram of a side elevation partly in section of an embodiment of subject apparatus taken along 2—2 of FIG. 1.

It is apparent in FIG. 2 that the outside diameter of circular stator 32 measured at its base, i.e., the end of the stator closest to the rotor, is the same as the "root diameter" of circular rotor 33 measured at the end (or base) of the rotor closest to the stator. The "root diameter" is the diameter of the rotor measured through the center point of its end across a circle defined by the deepest point of indentation (depth) of channels 35 running between vanes 34. The ratio of the outside diameter of the stator to the root diameter of rotor, both measured at their bases (the ends most proximate to each other) is in the range of 1:1 to about 0.8:1. As this ratio is reduced below 1:1 the advantageous bubble pattern referred to above is gradually lost. The reduction in diameter results, among other things, in extreme bubble agglomeration which leads to unacceptable surface turbulence. Excessive surface turbulence is responsible for causing impurities floating on the surface of the melt to reenter the melt. The point at which surface turbulence becomes unacceptable as the ratio is reduced is dependent on several factors such as rotor speed, gas throughput, clearance between rotor and stator and between rotor and vessel, and depth of channels 35. It is considered that the ratio about 0.8:1 is the lowest value that accomodates these factors. It will be understood then that the ratio of 1:1 is optimum and a ratio of about 0.9:1 is preferred as the lower limit.

The stator can be cylindrical or tapered. A preferred taper is one where the body of the stator flares out to provide a larger body diameter than base diameter. The increase from base diameter to body diameter can be in the range of up to about thirty percent based on the diameter of the base. The flare can be from 30 to 60 degrees. This design gives a slightly better performance in terms of surface turbulence at high rotor speeds and high gas throughputs, may inhibit bubble agglomeration to a greater degree than a cylindrical stator, and provides more support for the device.

Typical dimensions for the vessel (outer shell) are length: 55 inches, width: 49 inches, and height: 57 inches; for the stator, outer diameter of base: 5 inches, with or without taper (if tapered, same base diameter of 5 inches flared out at a 45 degree angle to provide a 6 inch outer body diameter); for the rotor, root diameter: 5 inches and outside diameter, i.e., measured at tips of vanes; 7.5 inches. Typical rotor speeds for such a vessel, rotor, and stator are 400 to 600 revolutions per minute with a 3 to 5 standard cubic feet per minute gas throughput.

I claim:

1. In an apparatus for refining molten metal comprising, in combination:

(a) a vessel;

(b) inlet and outlet means for molten metal and gases; and (c) at least one rotating gas distributing means disposed in said vessel, said gas distributing means comprising (i) a rotatable shaft coupled to drive means at its upper end and fixedly attached to a vaned circular rotor at its lower end; (ii) a hollow stationary sleeve surrounding said shaft and fixedly attached at its lower end to a hollow circular stator; (iii) an axially extending passageway for conveying and discharging gas into the clearance between the rotor and stator, said passageway being defined by the inner surface of the sleeve and stator and the outer surface of the shaft and (iv) means for providing gas to the upper end of the passageway under sufficient pressure to be injected into the vessel, the improvement comprising utilizing, in the combination, a smooth outer surface construction for the stator and a ratio of the outside diameter of the stator to the root diameter of the rotor in the range of 1:1 to about 0.8:1, said diameters being measured respectively, at the base of the stator and the base of the rotor closest to each other in the apparatus.

2. The apparatus defined in claim 1 wherein the ratio is in the range of 1:1 to about 0.9:1.

3. The apparatus defined in claim 1 wherein the ratio is 1:1.

4. The apparatus defined in claim 1 wherein the stator is tapered in such a manner that the largest outside diameter of the stator is greater than the outside diameter of the stator measured at the base of the stator closest to the rotor.

* * * * *